US006497936B1

(12) United States Patent
Desai et al.

(10) Patent No.: US 6,497,936 B1
(45) **Date of Patent: *Dec. 24, 2002**

(54) METHOD AND APPARATUS FOR DYEING AND TREATING YARNS

(75) Inventors: Peter Desai, Cartersville, GA (US); Jeffrey Lovelady, Spring, GA (US)

(73) Assignee: Mannington Mills, Inc., Salem, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/333,156

(22) Filed: Jun. 14, 1999

(51) Int. Cl.[7] ..... D05C 17/02
(52) U.S. Cl. ..... 428/97; 428/85; 428/96
(58) Field of Search ..... 428/85, 97, 96

(56) References Cited

U.S. PATENT DOCUMENTS

| | | | | | |
|---|---|---|---|---|---|
| 3,949,124 | A | * | 4/1976 | Jilla | 428/96 |
| 4,313,312 | A | * | 2/1982 | Vermeer et al. | 28/255 |
| 4,401,712 | A | | 8/1983 | Morrison | 428/289 |
| 4,533,435 | A | | 8/1985 | Intili | 162/161 |
| 4,899,426 | A | | 2/1990 | Hand | 28/252 |
| 4,934,134 | A | | 6/1990 | Niederer | 57/350 |
| 4,949,440 | A | | 8/1990 | Niederer | 28/271 |
| 5,027,486 | A | | 7/1991 | Niederer | 28/258 |
| 5,350,426 | A | * | 9/1994 | Jenkins | 8/539 |
| 5,482,764 | A | * | 1/1996 | McBride et al. | 428/96 |
| 5,491,858 | A | | 2/1996 | Massotte et al. | 8/151.2 |
| 5,557,953 | A | | 9/1996 | Massotte et al. | 68/205 |
| 5,573,553 | A | | 11/1996 | McBride et al. | 8/115.56 |
| 5,594,968 | A | | 1/1997 | Haselwander et al. | 8/149 |
| 5,809,810 | A | | 9/1998 | Enderlin | 68/200 |
| 5,891,201 | A | | 4/1999 | Enderlin et al. | 8/549 |
| 5,925,149 | A | * | 7/1999 | Pacifici et al. | 8/481 |

FOREIGN PATENT DOCUMENTS

| | | |
|---|---|---|
| JP | 63-50575 | 3/1988 |
| WO | WO9851189 | 11/1998 |
| WO | WO9857726 | 12/1998 |

OTHER PUBLICATIONS

Tortora, Phyllis G. Undestanding Textiles, Fourth Edition. MacMillian Publishing Company, New York. 1992. p. 408.*
AN 1987–173958, Database WPI, Section Ch, Week 198725, Derwent Publications Ltd., London, GB; Class A11, JP 62 104986 A (May 15, 1987).
AN 1981–24544D, Database WPI, Section Ch, Week 198114, Derwent Publications Ltd., London, GB, Class A11, JP 56 015471 A (Feb. 14, 1981).
Copy of European Search Report dated Dec. 10, 2001.

* cited by examiner

*Primary Examiner*—Terrel Morris
*Assistant Examiner*—Jenna-Leigh Befumo
(74) *Attorney, Agent, or Firm*—Kilyk & Bowersox, P.L.L.C.

(57) ABSTRACT

An apparatus and method are described for treating one or more yarn strands before or after the strand is dyed. The apparatus preferably includes a modified space dyeing apparatus having a dye applicator modified to be used as a treatment composition applicator for treating a yarn strand. The apparatus enables a high speed yarn dyeing and treatment method. Also described is a method and composition for treating yarn with a polyphenolic derivative composition to form a bleach-resistant yarn.

8 Claims, No Drawings

METHOD AND APPARATUS FOR DYEING AND TREATING YARNS

BACKGROUND OF THE INVENTION

The present invention relates to a method and apparatus for dyeing yarn and treating the dyed yarn. The present invention further relates to a textile substrate containing dyed and treated fibers.

Various methods and machines have been developed for dyeing yarn. Machines for applying multiple dyes to a yarn strand are disclosed in U.S. Pat. Nos. 5,491,858 and 5,557,953 to Massotte et al., and U.S. Pat. No. 5,891,201 to Enderlin et al., which are herein incorporated by reference in their entireties. Each of these patents provides a method of dyeing yarn strands with different dye colors during a single process wherein the yarn strand does not need to be wound and unwound between different dyeing steps. The yarns obtained by treatment according to the methods and apparatus described in the aforementioned patents have conventionally been wound onto a spool, core, mandrel, or the like. If the yarn is to be subsequently treated, the yarn is unwound and either treated by a treatment apparatus, or formed into a textile product which can then be treated.

U.S. Pat. No. 5,594,968 to Haselwander et al. relates to a method and apparatus for dyeing yarn to obtain substantially random variations of dye along the length of yarn strands, and is incorporated herein by reference in its entirety. The patent further relates to a method and apparatus for applying dyes of different colors to moving yarn strands while varying the amount of each dye color applied to the yarn so that the length of each dye color or dye spot on the yarn and the location of the dye spot on the yarn may be varied, preferably in a practically random pattern of practically unlimited pattern length or repeat.

Yarns produced according to the methods and apparatus described in the patent are known as space dyed yarns and find utility in certain carpets designed for a multi-color effect. Multi-colored carpets having no visible color patterns are desirable for certain carpet stylings. When yarns made according to the methods of U.S. Pat. No. 5,594,968 and other types of dyed yarns are formed into a carpet, the resulting carpet is often treated with a bleach-resistant composition. Unfortunately, a long lasting and complete bleach-resistant treatment is difficult to achieve on carpets due to the inability of the treatment composition to penetrate deeply and protect the entire carpet pile. Also, many carpets use dyed yarns in combination with solution dyed fibers to form various patterns. Some carpets can contain from 50% to 99% solution dyed fibers. However, while solution dyed fibers are bleach-resistant, dyed yarns are not and need to be treated. Thus, even if a carpet contains a small amount of dyed yarn, the entire carpet will be treated with chemicals even though only a portion of the carpet only really needs to be treated. Thus, a lot of treatment is unnecessary and wasteful. Accordingly, it would be desirable to treat yarns with bleach-resistant or other chemical treatments prior to forming the yarns into a finished product, such as a carpet.

It would be also desirable to provide a method of treating dyed yarns which provides a treatment step in-line with a dyeing step such that a yarn can be dyed and subsequently treated in a single operation without the need to collect the yarn between the dyeing and treating processes.

It would be also desirable to provide an apparatus for carrying out a method of dyeing and treating a yarn strand in a single continuous operation.

SUMMARY OF THE INVENTION

The present invention relates to a method and apparatus for chemically treating a dyed yarn at substantially the same time the yarn is dyed. More particularly, the present invention relates to a method for space dyeing and substantially simultaneously treating a yarn strand by utilizing an apparatus having a treatment station located substantially adjacent, and preferably immediately downstream from a yarn dyeing station so that yarn can be treated, for example, for bleach-resistance, immediately before or after the yarn is dyed. According to the present method, there is no need to wind and then unwind a dyed yarn after dyeing in order to treat the yarn with a treatment composition, such as, but not limited to, a bleach-resistant composition, a stain-resistant composition, a microbicidal composition, a hydrophobic repellent composition, or the like.

The present invention also relates to a method of treating yarn for bleach-resistance by contacting the yarn with a polyphenolic derivative bleach-resistant composition. More particular, the present invention relates to a method of treating a continuous strand of yarn with a polyphenolic derivative bleach-resistant composition immediately before or after dyeing or space dyeing the continuous strand.

The present invention also relates to an apparatus for dyeing and chemically treating yarn. The apparatus has a yarn supplying device, a treated yarn collection device, at least one yarn dyeing station located between the yarn supplying device and the yarn collection device, and at least one yarn treatment station located between the yarn supplying station and the yarn collection device, either upstream or downstream, but preferably immediately adjacent, the yarn dyeing station. Yarn which is dyed and chemically treated by the apparatus of the present invention is passed from an upstream location at the yarn supplying device to a downstream location at the yarn collection device. According to a preferred embodiment, yarn passes in-line from the yarn supplying device downstream to at least one yarn dyeing station, and further downstream from the at least one yarn dyeing station to the at least one yarn treatment station. Yarn treated in the at least one yarn treatment station passes downstream to the yarn collection device. The yarn dyeing station(s) and yarn treatment station(s) respectively dye and chemically treat one or more strands of yarn as it travels from the yarn supplying device to the yarn collection device at preferably a continuous rate of travel, preferably at a rate of about 1000 feet per minute (fpm) or greater. According to a preferred embodiment of the present invention, the yarn treatment station chemically coats or otherwise chemically treats the dyed yarn with, a treatment composition substantially immediately after the yarn has been dyed with one or more dyes at the yarn dyeing station(s).

The present invention further relates to a textile substrate comprising a primary backing with textile fibers extending upwardly from the backing and forming a surface and a secondary backing fastened to the opposite side of the primary backing. The textile fibers comprise dyed and chemically treated fibers as well as textile fibers which have not been chemically treated.

The present invention, in addition, relates to a textile substrate comprising a primary backing with textile fibers extending upwardly from the backing and forming a surface and a secondary backing fastened to the opposite side of the primary backing, wherein at least a portion of the textile fibers are individually dyed and chemically treated such that these individual fibers are uniformly and completely chemically treated.

Additional features and advantages of the present invention will be set forth in part in the description which follows, and in part will be apparent from the description, or may be learned by practice of the present invention. The objectives and other advantages of the present invention will be realized and attained by means of the elements and combinations particularly pointed out in the written description including the appended claims.

It is to be understood that both the foregoing general description and the following detailed description are exemplary and explanatory only and are intended to provide further explanation of the present invention, as claimed.

DETAILED DESCRIPTION OF THE PRESENT INVENTION

The present invention relates to methods of dyeing and chemically treating textile fibers individually and further relates to textile substrates which contain these textile fibers alone or with other textile fibers. For purposes of the present invention, the textile substrate is preferable a broadloom carpet, modular tile, or a wide rolled carpet (e.g., 6 feet). The textile substrate comprises textile fibers defining a fibrous phase, a primary backing to which the textile fibers are secured, and a secondary backing secured to the primary backing. For purposes of the present invention, the term "textile substrate" relates to, but is not limited to, a fiber, web, yam, thread, sliver, woven fabric, knitted fabric, non-woven fabric, upholstery fabric, tufted carpet, and piled carpet formed, from natural and/or synthetic fibers. For purposes of the present invention, the term "fiber" and "yam" are used interchangeable and are textile fibers which can be natural or synthetic and which can form a part of the textile substrate. Any conventional natural or synthetic fiber can be used for purposes of the present invention as long as such fiber is capable of being dyed and/or chemically treated as described herein.

In more detail, the present invention relates to a method of treating a yarn strand which includes dyeing at least a portion or segment of the strand by contacting the strand with dye supplied from, a first dye applicator. The portion or segment is also treated before or after dyeing the portion or segment with a treatment composition supplied from a first treatment applicator. The treatment composition can be applied to the portion or segment of the yam which has been dyed or can be applied to the entire length of the yarn after one or more dyes have been applied onto the yarn. Preferably, the treatment composition is applied only after the dyeing of the yarn by one or more dyeing stations is completed. The treatment composition may be a bleach-resistant composition, a stain-resistant composition, an anti-microbial composition, a hydrophobic repellent composition, or any other yarn treatment composition known to those of skill in the art. The treatment composition may be affixed or cured to the yarn strand after application such as by steam treatment, drying, or the like. The resulting yarn strand is a dyed and treated yarn strand.

According to a preferred embodiment of the present invention, a bleach resistant composition is applied to the yam strand. The bleach resistant composition may include a polyphenolic derivative composition, for example, a powdered polyphenolic derivative composition in solution, such as dissolved in an acidic aqueous solution.

The yarn strand may be dyed immediately before or after being treated with the treatment composition. If the treatment composition is a bleach-resistant composition, the yam strand is preferably dyed before being treated. If the treatment composition is a fixing agent or primer composition it may preferably be applied to the yarn strand before the strand is dyed. The yam strand may be dyed with two or more dyes supplied from two or more dye applicators, either before or after treating.

Preferably, the methods of the present invention enable a high speed dyeing and chemically treating of al yarn strand. The yarn strand preferably travels at a continuous rate between the dyeing and treating stations, and may travel at a rate of greater than about 100 fpm, for example, a rate of greater than about 1000 fpm, and more preferably at a rate of about 1500 fpm. Preferably, the yarn strand travels in a substantially linear direction from a dye applicator to a treatment applicator, or vice versa. Drying or fixing devices, for example, heating, drying, or steaming zones, are preferably provided immediately after each of the dyeing and treating stations.

The yarn treatment station(s) may be used to apply a treatment composition to the dyed yarn for the purpose of bleach-resistance, stain resistance, chemical repellency, and the like. Mixtures of various treatment chemicals can be used as long as they are compatible with each other. According to a preferred embodiment of the present invention, a method for treating yarn strands is provided which utilizes a modified version of the dyeing apparatus of U.S. Pat. Nos. 5,491,858 or 5,594,968. The apparatus is modified such that at least one of the dye applicators is replaced with or equipped with a device, bath, or tub which applies a treatment composition to the yarn. The composition(s) is preferably applied after all dyeing of the yarn strand is complete, that is, downstream of all dye treatment stations of the apparatus.

Two or more dye applicators of a conventional yarn dyeing apparatus can be modified to provide either two different chemical treatments, or provide a repeat treatment of the same treatment compositions.

The present invention also provides a method of dyeing and treating yarns which utilizes an apparatus according to the present invention. According to preferred embodiments of the present invention, a method of treating dyed yarns such as, for bleach-resistance, is provided wherein an apparatus according to the present invention is utilized to apply a chemical composition, such as polyphenolic derivative bleach-resistant composition, to a yarn which can be subsequently formed into a chemically-resistant textile substrate, such as a carpet. The yarn to be treated can be dyed before entering the apparatus or can be dyed by the same apparatus. Also, the yarn can be treated without any dyeing of the yarn. Treating the dyed yarn in-line after dyeing and before the yarn is collected, wound, or otherwise taken-up enables a high speed process for dyeing and treating yarns, and enables a complete, thorough and integral treatment of yarns strands with the treatment composition.

According to the present invention, a conventional space dyeing machine can be modified such that one or more of the plurality of dye baths can be replace with or supplied with a treatment composition instead of a dye composition as required by the machine manufacturer. Heat, sonic energy, stirring means, or other methods and apparatus may be employed to heat, stir, or otherwise pre-treat the treatment composition before it is applied to the yarn.

As with the apparatus disclosed in U.S. Pat. Nos. 5,491,858 and 5,594,968, more than one yarn strand can be simultaneously treated and optionally dyed according to the method of the present invention.

Preferably, regardless of the constituents of the treatment composition, the treatment composition is in the form of a solution that readily coats a yarn strand which contacts the solution. For treatment compositions comprising a powder material, it is preferable to dissolve the powder in a non-aqueous or aqueous solvent, for example, water, to form a treatment solution. In this respect, it is desirable to minimize precipitation or settling of the treatment composition in the solution, which can be accomplished, for instance, by adjusting the concentration of the treatment composition in the solution and/or by other factors including temperature and agitation.

According to the present invention, more that one treatment composition may be used to treat the yarn simultaneously. For example, if two or more treatment compositions are compatible with one another, they can be combined in a treatment applicator and be simultaneously applied to yarn strands treated with the applicator. If combined, it is preferable that the two or more different treatment compositions are not reactive with one another, and it is preferred that none of the treatment compositions inhibits a thorough or complete treatment of the yarn strand(s) with the remaining treatment composition(s)

The treatment composition preferably is characterized in that the composition readily wets-out on a yarn strand and forms a uniform coating on the strand. Preferably, the treatment composition is a quick-drying composition which dries within about 5.0 minutes, more preferably within 3.0 minutes, after being applied to the yarn when heated to about 300° F. at a fixing, heating, or drying station. The apparatus of the present invention may be modified relative to a conventional space drying apparatus to provide a quick drying or high temperature station prior to the yarn collection device. The device may also be provided with one or more pre-treatment stations such as a ore-steamer or sparge steamer for preparing a yarn strand for a dyeing and/or treating process.

With respect to imparting bleach-resistance to the yarn, a polyphenolic derivative composition is preferably used. Preferably, the polyphenolic derivative composition has a non-ionic character, is readily soluble in water, and is substantially comparable with non-ionic agents, anionic agents, and acids exhibiting pH values as low as about 3.0. The composition is preferably a solution of polyphenolic derivative powder and an acetic aqueous solvent. Preferably, the concentration of the composition in the acetic aqueous solution is at a level low enough to maintain all of the composition dissolved within the solution. A more preferred composition is a solution of polyphenolic derivative powder in an acetic aqueous solution having a concentration of the powder of from about 2.0 to about 2.5% by weight based on the weight of the solution. A preferred polyphenolic derivative powder for use in a bleach-resistant treatment is FADEX® CLM available from Clariant Corporation, Charlotte, N.C. A solution of FADEX® CLM powder in an acidic aqueous solution having a concentration of the FADEX® CLM powder of from about 2.0% by weight to about 2.5% by weight based on the weight of the solution, and a solution pH of from about 4.0 to about 5.0 can be used. Acetic acid may be included in the solution to adjust the pH.

Preferably, a yarn strand is contacted with the solution for less than about 10 seconds after the yarn is dyed on the same apparatus, more preferably, less than about 3 seconds after the yarn strand is dyed on the same apparatus.

Other treatment compositions may be applied instead of, or together with, a bleach-resistant composition. A preferred anti-microbial composition which is compatible with the FADEX® CLM powder and can be applied from a common solution with the FADEX® CLM composition is MICROBAN biocide available from Microban Products Company, Huntersville, N.C. Other microbicidal compositions which may be employed according to the present invention include the antimicrobial additives described in U.S. Pat. No. 4,533,435, which is herein incorporated in its entirety by reference.

The present invention also relates to a method of making a bleach-resistant carpet, which includes contacting a yam strand with a treatment composition on a device according to the present invention, affixing the treatment composition to the yarn strand to form a treated yam; and forming the treated yarn into a carpet. In a preferred embodiment, the composition is a polyphenolic derivative bleach-resistant composition comprising a powder material dissolved in an acidic aqueous solution to form a bath which is applied to the yarn strand. The solution may have a pH of from about 3.0 to about 8.0, more preferably from about 4.0 to about 5.0. As with the application of other bleach resistant compositions, the yam strand is preferably dyed before it is contacted with the polyphenolic derivative solution.

The present invention also relates to an apparatus for dyeing and treating yarn stands, wherein the apparatus includes a yam supplying device, at least one dye applicator, at least one treatment applicator, and a treated yarn collection device. The dye applicator and the treatment applicator are arranged between the yarn supplying device and the treated yarn collection device. The dye applicator applies at least one dye to a portion or segment of a yarn strand or simultaneously to many lengths of many yarn strands. The treatment applicator applies at least one treatment composition to a length of a yarn strand or simultaneously to many lengths of many yarn strands. The yarn preferably travels at a substantially continuous rate from the yam supplying device to the treated yam collection device. The apparatus may include one or more dye applicators disposed between the yarn supplying device and the treatment applicator.

The apparatus of the present invention may include a modified but otherwise conventional space dyeing apparatus. The apparatus may include two or more treatment applicators. If two or more treatment applicators are included, the applicators may respectively apply different or the same treatment compositions to a strand of yarn. Optionally, the apparatus contains at least one treatment applicator and no dye applicator.

The treatment applicator can be the same design as the dye applicator except for the product applied.

The treated yarn collection device may preferably collect dyed and treated yarn at a rate of at least 10 feet per minute, more preferably at a rate of at least about 1000 fpm. Preferably, the treated yam collection device collects dyed and treated yarn at a rate of at least about 1500 feet per minute.

As an example of an apparatus according to the present invention, the apparatus for space dyeing yarn disclosed in U.S. Pat. No. 5,594,968 is modified. The apparatus of FIGS. 1–3 from U.S. Pat. No. 5,594,968 is provided with eight different dye stations or applicators referred to as dye stations 12, 14, 16, 18, 20, 20, 24, and 26 in the patent. According to the present invention, one or more of the eight dye stations are modified to instead provide one or more treatment applicator stations. Preferably, the apparatus as shown in FIGS. 1–3 of the patent is modified such that the $7^{th}$ and $8^{th}$ dye stations (reference numerals 24 and 26) are modified to provide the application of the treatment composition instead of a dye.

Preferably, the apparatus of the present invention can dye and treat yarn as the yarn travels at a rate of about 1500 feet per minute, or more. In addition to the benefits of speed, the present apparatus and method provides a complete treatment on the entire outer surface of a yarn and therefore provides a product made from the yarn having improved properties over a product treated with the same composition but after the yarn is first formed into the carpet.

Alternatively, one or more treatment applicators can be used prior to at least one dye applicator or in between dye applicators. For example, the yarn can be treated by a first treatment applicator with a fixing agent, subsequently dyed by one or more dye applicators, and thereafter treated by one or more additional treatment applicators which provide a bleach-resistant composition, a stain-resistant composition, an anti-microbial composition, a hydrophobic repellent composition, or the like.

Any conventional chemical treatment composition can be used in the present invention as long as the composition is compatible with dyed yarn or will not negatively effect the dyeing of the yarn. Those skilled in the art, in view of the present application, will readily know the types of compositions which can be applied following the present invention. The amounts and concentrations can be adjusted depending upon the type and/or level of protection that one wishes to afford to the yarn.

The method described above and in particular the use of a space dyeing machine preferably dyes multiple strands of yarn at one time and the present invention provides the ability to chemically treat these multiple strands of dyed yarns essentially at or nearly at the same time the dyeing is occurring. Further, un-dyed yarns or pre-dyed yarns can simply be chemically treated by the process of the present invention. Further, with the use of a space dyeing machine or other similar apparatus, the dyed and chemically treated yarn can then be wound or sent to a warping machine or a tufting machine, or both in order to be placed into a primary backing to form a textile substrate.

Typically, a textile substrate comprises a primary backing with textile fibers extending upwardly from the backing and forming a surface. A secondary backing is fastened or fixed to the side of the primary backing which is opposite the wearing surface of the textile substrate. Conventional primary backings and secondary backings and methods of forming this textile substrate are known to those skilled in the art and can be used in the present invention. In the present invention, a textile substrate can be formed with the textile fibers which have been dyed and chemically treated in accordance with the present invention. Accordingly, the textile substrate can contain a primary backing with textile fibers extending upwardly from the backing and forming a surface, wherein at least a portion of the textile fibers would be individually dyed and individually chemically treated as described above. It is possible that all of the textile fibers are dyed and chemically treated or only a few. The remaining textile fibers can be fibers which have not been chemically treated. For instance, the textile substrate can contain a primary backing with textile fibers extending upwardly from the backing and forming a surface wherein a portion of the textile fibers are dyed and chemically treated according to the present invention and at least a portion of the textile fibers are solution dyed fibers. As described earlier, the benefit with this embodiment is that the chemical treatment of the entire carpet is not necessary and only those fibers which require chemical treatment are chemically treated; thus, resulting in a considerable cost savings in the manufacturing of the textile substrate. In addition, a textile substrate having textile fibers which have been individually dyed and individually chemically treated results in a textile substrate which is more chemically resistant, such as bleach resistant, than treating the entire carpet which leads to the application of more of the chemical resist composition than necessary and can lead to a lack of uniform coverage of each individual textile fiber. In fact, it is unlikely that the entire surface area of the textile fiber will be chemically treated in a uniform manner if chemical treatment occurs once the textile substrate is formed. Thus, the present invention has numerous benefits which are further reflected in the examples which follows.

The present invention will be further clarified by the following examples which are intended to be purely exemplary of the present invention.

EXAMPLES

Yarn strands were dyed and treated on an apparatus according to the present invention which included a modified version of the space dyeing machine set forth in U.S. Pat. No. 5,594,968. In particular, a space dyeing apparatus having eight dye stations as described in U.S. Pat. No. 5,594,968 and shown in FIGS. 1–3 of that patent was modified such that the seventh and eighth dye stations were converted to treatment stations for the application of a polyphenolic derivative bleach-resistant composition. For a single pass application of the treatment composition only the seventh dye station was modified to be a treatment station, and the eighth station was not used. For double pass application of the treatment composition, both the seventh and eighth stations were modified to be treatment stations for applying the same treatment composition. The apparatus was run under the following conditions:

| Single Pass Machine Settings: | |
|---|---|
| Yarn Speed (FPM) | 650 |
| Pre-Feed % | 145 |
| Belt Speed | 13 |
| Pre-Steamer | on |
| Post Steamer #1 | on |
| Post Steamer #2 | on |
| Sparge Steamer #1 | 212 +/− 18 |
| Sparge Steamer #2 | 212 +/− 18 |
| Sparge Steamer #3 | 212 +/− 18 |
| Dryer Zone #1 | 310 +/− 20 |
| Dryer Zone #2 | 300 +/− 10 |
| Dryer Zone #3 | 300 +/−10 |
| Dryer Zone #4 | 300 +/− 10 |
| Dryer Zone #5 | 300 +/− 10 |
| Dryer Zone #6 | 300 +/− 10 |
| Head Height | 0.0900 +/− 0.01 |
| Dye Roller #4 RPM | 250 +/− 50 |
| Dye Roller #5 RPM | 250 +/− 50 |
| Dye Roller #6 RPM | 250 +/− 50 |
| Dye Roller #7 RPM | 250 +/− 50 |
| Dye Roller #7 RPM | 250 +/− 50 |
| Dye Roller #8 RPM | 250 +/− 50 |
| Post Wash | off |
| Extractor | off |
| Steam Knife | on |

| Double Pass Machine Settings: | |
|---|---|
| Yarn Speed | 1100 |
| Pre-Feed % | 145 |
| Belt Speed | 13 |
| Pre-Steamer | on |
| Post Steamer #1 | on |
| Post Steamer #2 | on |

-continued

| | |
|---|---|
| Sparge Steamer #1 | 212 +/− 18 |
| Sparge Steamer #2 | 212 +/− 18 |
| Sparge Steamer #3 | 212 +/− 18 |
| Dryer Zone #1 | 310 +/− 20 |
| Dryer Zone #2 | 300 +/− 10 |
| Dryer Zone #3 | 300 +/− 10 |
| Dryer Zone #4 | 300 +/− 10 |
| Dryer Zone #5 | 300 +/− 10 |
| Dryer Zone #6 | 300 +/− 10 |
| Head Height | 0.1000 +/− 0.01 |
| Dye Roller #7 | 250 |
| Dye Roller #8 | 250 |
| Post Wash | off |
| Extractor | off |
| Steam Knife | off |

Examples I–III

The treatment composition applied at the seventh (single pass) and eighth stations (double pass) was a bleach-resistant composition containing an acetic aqueous solution of FADEX® CLM powder available from Clariant Corporation, Charlotte, N.C. The solution of FADEX® CLM powder contained from about 2.0% by weight to about 2.5% by weight of the FADEX® CLM powder, and was adjusted with acetic acid to a solution pH of from about 4.0 to about 5.0.

After dyeing and treatment in the apparatus under the machine conditions set forth above, the yarns were formed into carpets which were exposed to bleach at various concentrations and for various numbers of bleaching cycles. The bleach was applied by a hand held pump type sprayer and the surface of the carpet was misted until saturated. After soaking for one hour, the carpet was rinsed using a commercial carpet cleaning extractor filled with hot water only. After each bleaching cycle, the carpet was allowed to substantially completely dry prior to any subsequent evaluation or bleaching cycle.

In the examples set forth below, the yarn used was a 1245/2 denier, Dupont Antron B type nylon 6—6 yarn, made by Dupont Fibers via a melt extrusion process. The control yarn was dyed by the space dyeing apparatus but was not treated with the FADEX® CLM bleach-resistant composition.

In Example I, yarn was space dyed by the first six dye stations of an apparatus according to U.S. Pat. No. 5,594,968 and was subsequently treated in the seventh and eighth stations (a two pass treatment) with an aqueous solution of 10 g/l FADEX® CLM. The FADEX® CLM solution had a pH of between about 3.0 and about 4.0.

In Example II, the yarn was treated as in Example I with the exception that the FADEX® CLM solution had a concentration of 30 g/l of the bleach resistant powder.

In Example III, the yarn was treated as in Examples I and II, with the exception that the solution of FADEX® CLM powder had a concentration of 50 g/l of the FADEX® CLM powder.

In the results set forth below, bleach resistance was rated on a scale of 1.0 to 5.0, with 1.0 being the poorest bleach resistance and 5.0 being the best bleach resistance. Without wishing to be bound by theory, it is believed that the higher concentrations of bleach contained less water and wet-out more poorly on the yarn, attributing to a lesser bleaching effect than with the lower bleach concentration solutions.

As can be seen below, the yarns treated with the apparatus and method of the present invention exhibited excellent bleach-resistance compared to the control yarn, particularly when treated with solutions of 30 g/l or more FADEX® CLM powder in an acetic aqueous solution.

Control Yarn

| Number of | Bleach Solution Concentrations | | |
|---|---|---|---|
| Cycles | 5% | 50% | 100% |
| 1 | 2.0 | 2.5 | 4.0 |
| 2 | 1.0 | 2.5 | 3.5 |

Example I

Treated With 10 g/l Solution of FADEX® CLM in Stations 7 and 8

| Number of | Bleach Solution Concentrations | | |
|---|---|---|---|
| Cycles | 5% | 50% | 100% |
| 1 | 2.5 | 3.0 | 4.0 |
| 2 | 2.5 | 3.0 | 3.5 |

Example II

Treated With 30 g/l Solution of FADEX® CLM in Stations 7 and 8

| Number of | Bleach Solution Concentrations | | |
|---|---|---|---|
| Cycles | 5% | 50% | 100% |
| 1 | 4.5 | 5.0 | 5.0 |
| 2 | 3.5 | 4.5 | 5.0 |

Example III

Treated with 50 g/l Solution of FADEX® CLM in Stations 7 and 8

| NUMBER OF | Bleach Solution Concentration | | |
|---|---|---|---|
| CYCLES | 5% | 50% | 100% |
| 1 | 5.0 | 4.5 | 4.5 |
| 2 | 4.0 | 4.5 | 4.5 |
| 3 | 4.0 | 4.5 | 4.5 |
| 4 | 4.0 | 4.5 | 4.0 |
| 5 | 4.0 | 4.5 | 4.0 |
| 6 | 3.5 | 4.5 | 4.0 |
| 7 | 3.5 | 4.0 | 4.0 |
| 8 | 3.0 | 4.0 | 4.0 |
| 9 | 3.0 | 4.0 | 4.0 |
| 10 | 3.0 | 4.0 | 4.0 |

In Example IV, the apparatus described in Examples 1–3 was used but the treatment solutions further contained an anti-microbial component in addition to the FADEX® CLM component. The anti-microbial composition was Microban from Microban Products Company, Huntersville, N.C. As can be seen from the results set forth below, excellent bleach-resistant properties can be imparted to a yarn While simultaneously applying an anti-microbial composition to the yarn. The Microban anti-microbial composition was compatible with the aqueous FADEX® CLM solution enabling both components to be applied to the yarn simultaneously from a single treatment bath.

Control Yarn

| Number of | Bleach Solution Concentrations | | |
|---|---|---|---|
| Cycles | 10% | 50% | 100% |
| 1 | 2.0 | 2.0 | 2.0 |
| 1 | 4.5 | 4.5 | 4.5 |
| 2 | 4.5 | 4.0 | 4.0 |
| 3 | 4.5 | 4.0 | 4.0 |
| 4 | 4.5 | 4.0 | 3.5 |
| 5 | 4.5 | 4.0 | 3.5 |
| 6 | 4.0 | 4.0 | 3.0 |
| 7 | 4.0 | 3.5 | 3.0 |
| 8 | 4.0 | 3.0 | 3.0 |
| 9 | 4.0 | 3.0 | 3.0 |
| 10 | 4.0 | 3.0 | 3.0 |

Other embodiments of the present invention will be apparent to those skilled in the art from consideration of the present specification and practice of the present invention disclosed herein. It is intended that the present specification and examples be considered as exemplary only with the true scope and spirit of the present invention being indicated by the following claims.

What is claimed is:

1. A textile substrate comprising a primary backing with textile fibers extending upwardly from the primary backing and forming a surface, wherein at least a portion of said textile fibers are individually dyed and individually chemically treated with a treatment composition selected from a stain-resistant composition, a bleach-resistant composition, an anti-microbial composition, or combinations thereof, and wherein at least another portion of the textile fibers are solution dyed fibers which are not chemically treated with said treatment composition.

2. The textile substrate of claim 1, wherein the dyed and chemically treated fibers are bleach-resistant.

3. The textile substrate of claim 1, wherein the dyed and chemically treated textile fibers are completely and uniformly treated.

4. The textile substrate of claim 1, wherein said treatment composition is a stain-resistant composition.

5. The textile substrate of claim 1, wherein said stain-resistant composition is a hydrophobic composition.

6. A textile substrate comprising a primary backing with textile fibers extending upwardly from the primary backing and forming a surface wherein at least a portion of said textile fibers are individually dyes and individually chemically treated with a treatment composition, wherein said treatment composition is a bleach-resistant composition, and wherein at least another portion of the textile fibers are not chemically treated with said treatment composition.

7. The textile substrate of claim 6, wherein said bleach-resistant composition comprises an aqueous solution of a polyphenolic derivative composition.

8. A textile substrate comprising a primary backing with textile fibers extending upwardly from the primary backing and forming a surface wherein at least a portion of said textile fibers are individually dyes and individually chemically treated with a treatment composition, wherein said treatment composition is an anti-microbial composition, and wherein at least another portion of the textile fibers are not chemically treated with said treatment composition.

* * * * *

UNITED STATES PATENT AND TRADEMARK OFFICE

CERTIFICATE OF CORRECTION

PATENT NO. : 6,497,936 B1 
DATED : December 24, 2002
INVENTOR(S) : Desai et al.

It is certified that error appears in the above-identified patent and that said Letters Patent is hereby corrected as shown below:

Title page,
Item [75], "Spring, GA" should read -- Rock Spring, GA --.

Column 12,
Line 18, "surface" should read -- surface, --;
Line 19, "dyes" should read -- dyed --;
Line 29, "surface" should read -- surface, --; and
Line 30, "dyes" shoud read -- dyed --.

Signed and Sealed this

Twenty-seventh Day of May, 2003

JAMES E. ROGAN
*Director of the United States Patent and Trademark Office*